US009228520B2

(12) United States Patent
Joos et al.

(10) Patent No.: US 9,228,520 B2
(45) Date of Patent: Jan. 5, 2016

(54) METHOD AND CONTROL TOOL FOR OPERATING A VALVE

(75) Inventors: Klaus Joos, Walheim (DE); Ruben Schlueter, Stuttgart (DE); Jens Neuberg, Stuttgart (DE); Helerson Kemmer, Vaihingen (DE); Holger Rapp, Ditzingen (DE); Haris Hamedovic, Moeglingen (DE); Joerg Koenig, Stuttgart (DE); Anh-Tuan Hoang, El Paso, TX (US); Bernd Wichert, Kernen (DE); Achim Hirchenhein, Trierweiler (DE)

(73) Assignee: ROBERT BOSCH GMBH, Stuttgart (DE)

( * ) Notice: Subject to any disclaimer, the term of this patent is extended or adjusted under 35 U.S.C. 154(b) by 953 days.

(21) Appl. No.: 13/377,769

(22) PCT Filed: Sep. 10, 2010

(86) PCT No.: PCT/EP2010/063301

§ 371 (c)(1),
(2), (4) Date: Mar. 27, 2012

(87) PCT Pub. No.: WO2011/042281

PCT Pub. Date: Apr. 14, 2011

(65) Prior Publication Data

US 2012/0191327 A1 Jul. 26, 2012

(30) Foreign Application Priority Data

Oct. 8, 2009 (DE) ..... 10 2009 045 469

(51) Int. Cl.
*F02D 41/40* (2006.01)
*F02D 41/20* (2006.01)

(52) U.S. Cl.
CPC ..... *F02D 41/20* (2013.01); *F02D 41/401* (2013.01); *F02D 2041/2055* (2013.01)

(58) Field of Classification Search
CPC ..... F02D 41/401; F02D 2041/2055
USPC ..... 123/472, 490; 701/105; 361/152, 153
See application file for complete search history.

(56) References Cited

U.S. PATENT DOCUMENTS 4,653,447 A * 3/1987 Linder et al. ..... 123/357
5,515,830 A 5/1996 Arakawa (Continued)

FOREIGN PATENT DOCUMENTS

| | | |
|---|---|---|
| CN | 101377166 | 3/2009 |
| DE | 102005032087 | 1/2007 |
| DE | 102009027290 | 4/2010 |
| EP | 1544446 | 6/2005 |

OTHER PUBLICATIONS

International Search Report, PCT International Application No. PCT/EP2010/063301, dated Feb. 18, 2011.

*Primary Examiner* — Erick Solis
(74) *Attorney, Agent, or Firm* — Kenyon & Kenyon LLP

(57) ABSTRACT

A method for operating a valve actuated by way of an actuator, in particular a fuel injection valve of an internal combustion engine of a motor vehicle, in which a first delay time is identified, which time characterizes a time difference between a point in time of a first change in an energization signal for the actuator and a point in time of a first change in the operating state of the valve corresponding to the first change in the energization signal. According to the present invention, from the first delay time at least one second delay time of the valve is inferred, which latter time characterizes a time difference between a point in time of a second change, different from the first change, in the energization signal and a point in time of a second change in the operating state of the valve corresponding to the second change in the energization signal.

10 Claims, 3 Drawing Sheets

(56) References Cited

U.S. PATENT DOCUMENTS 5,634,448 A * 6/1997 Shinogle et al. ..... 123/480
8,463,528 B2 * 6/2013 Cologna ..... 701/104
2003/0183204 A1 10/2003 Vierling et al.
2009/0056675 A1 * 3/2009 Thomas ..... 123/478

* cited by examiner

METHOD AND CONTROL TOOL FOR OPERATING A VALVE

FIELD OF THE INVENTION

The present invention relates to a method for operating a valve actuated by way of an actuator, in particular a fuel injection valve of an internal combustion engine of a motor vehicle, in which a first delay time is identified, which time characterizes a time difference between a point in time of a first change in an energization signal for the actuator and a point in time of a first change in the operating state of the valve corresponding to the first change in the energization signal. The present invention further relates to a control device for operating a valve of this kind, and to a computer program and a computer program product.

BACKGROUND INFORMATION

Delay times in real valves are usually non-infinitesimal, because of the fact that between the energization variables of the actuator driving the valve and a component (for example, a valve needle) characterizing the operating state of the valve, there exists a causal chain, made up of electromagnetic, mechanical, and/or hydraulic components, which requires a time that depends on their respective configuration and on operating parameters of the valve (fuel pressure, temperature) in order to transfer energization variables of the actuator to the valve needle.

SUMMARY

It is an object of the present invention to improve a method and a control device in such a way that information about various delay times of the valve can be obtained with the least possible outlay.

This object may be achieved according to an example embodiment of the present invention, in the context of the method of the kind cited initially, in that from the first delay time at least one second delay time of the valve is inferred, which latter time characterizes a time difference between a point in time of a second change, different from the first change, in the energization signal and a point in time of a second change in the operating state of the valve corresponding to the second change in the energization signal.

According to the present invention, at least in certain operating states of conventional actuator-actuated valves, a strong correlation exists between a first delay time of the valve and at least one second delay time, different therefrom, of the valve. Utilizing the principle according to the present invention it is thus advantageously possible, with a knowledge of the first delay time of the valve, which is identified, e.g., in conventional instrumental fashion, to infer at least one second delay time of the valve. The method according to the present invention thus allows information to be gained about a second delay time of the valve without requiring for that purpose further complex method steps such as, for example, further instrumental sensing of operating variables of the valve or the provision of additional sensor apparatus.

A further very particular advantage of an example embodiment of the present invention is the fact that with a knowledge of the first delay time, which can be acquired, for example, relatively simply in conventional instrumental fashion, it is possible to infer a second delay time that in some circumstances, because of the configuration of the valve or due to control methods that are necessary, cannot be acquired at all with the aid of conventional instrumental methods.

In accordance with an example embodiment, an example method according to the present invention can be applied with particular advantage in such a way that the first delay time is a closing delay time and the second delay time is an opening delay time. With many conventional valve types, the closing delay time is identifiable relatively easily from operating variables of the valve or of the actuator contained therein. In the case of an electromagnetic actuator, for example, an evaluation of the actuator current or actuator voltage can serve to identify the closing delay time. In contrast thereto, with common valve types it is usually more difficult to identify an opening delay time with the aid of such instrumental methods. The principle according to the present invention thus advantageously makes possible inferences as to second delay times in consideration of instrumentally acquired first delay times, so that instrumental actions for identifying the second delay times are superfluous.

Application of the example method according to the present invention is particularly advantageous in a ballistic operating range of the valve, which is characterized in that at least one movable component of the valve, e.g., a valve needle, executes a ballistic trajectory.

In a further very advantageous embodiment of the method according to the present invention, provision is made that the first delay time is identified for different values of an energization duration during which the actuator is being energized with the energization signal; and that the second delay time is inferred from a behavior of the first delay time over the energization duration. This variant of the present invention is characterized by particularly high precision.

According to the present invention, the second delay time can furthermore be identified as a function of a minimum value for the first delay time, referred to its behavior over the energization time.

In accordance with a further advantageous embodiment of the method according to the present invention, the second delay time can also be identified by way of a model that reproduces an operating characteristic of the valve, and to which at least the first delay time and/or its behavior over the energization duration are delivered as an input variable. Alternatively or additionally, the energization duration, further operating parameters (fuel pressure, temperature), and the like can also be delivered to the model.

Implementation of the present invention in the form of a computer program that is executable on a computing unit of a control device may be of particular significance.

Further features, potential applications, and advantages of the present invention are evident from the description below of exemplifying embodiments of the present invention that are depicted in the Figures. All features described or depicted, of themselves or in any combination, constitute the subject matter of the present invention, irrespective of their presentation and depiction in the description and the figures, respectively.

DETAILED DESCRIPTION OF EXAMPLE EMBODIMENTS

Figure 1C:
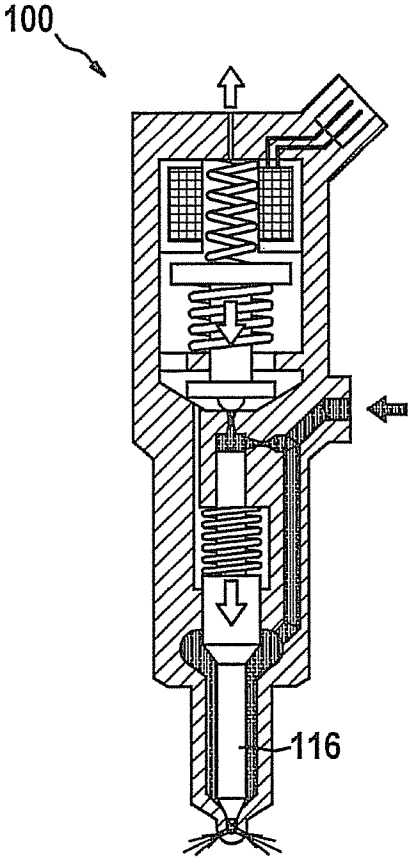
FIGS. 1*a*, 1*b*, 1*c* show a partial section through an injection valve, operating according to an example embodiment of the present invention, in various operating states.
Figure 1B:
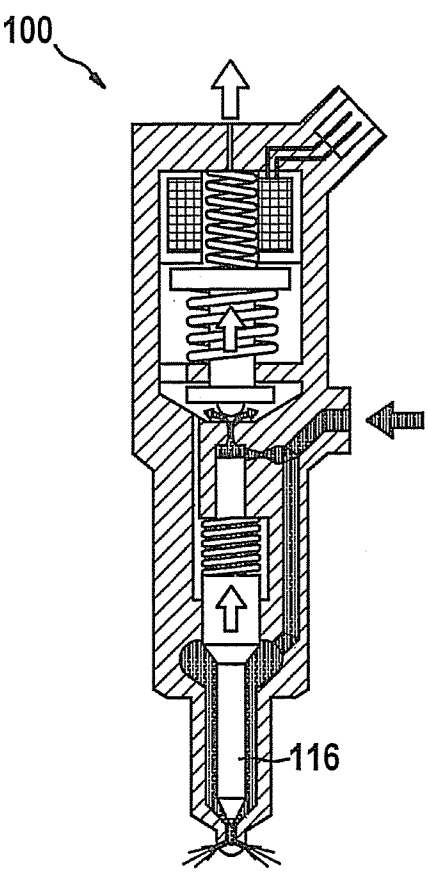
Figure 1A:
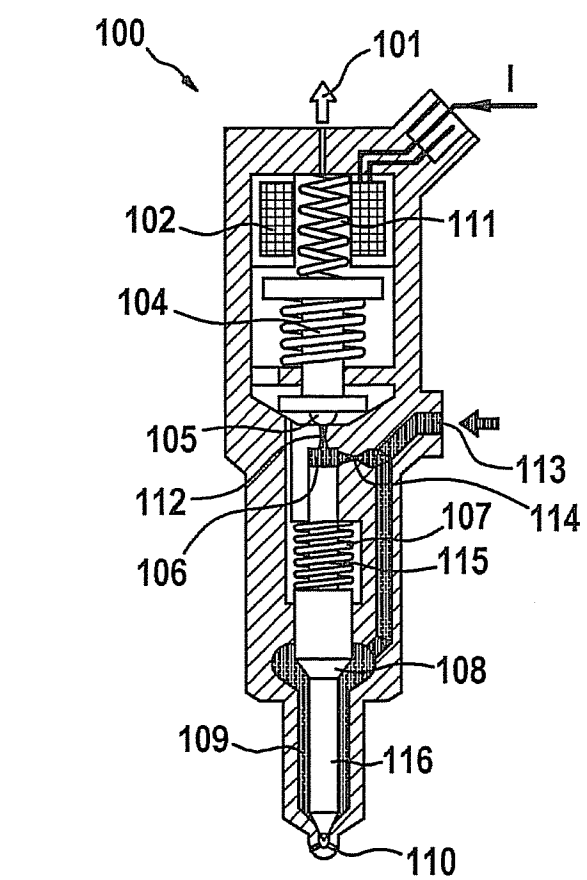

FIGS. 1*a* to 1*c* show an embodiment of an injection valve 100, provided for fuel injection, of a common rail fuel injection system of an internal combustion engine, in various operating states of an injection cycle.

FIG. 1*a* shows injection valve 100 in its idle state, in which it is not being energized by control device 200 associated with it. A solenoid valve spring 111 presses a valve ball 105 into a seat, provided therefor, of outflow throttle 112 so that a fuel pressure corresponding to the rail pressure, which also exists in the region of high-pressure connector 113, can build up in valve control space 106.

The rail pressure is also present in chamber volume 109 which surrounds valve needle 116 of injection valve 100. The forces applied by the rail pressure onto the end face of control piston 115, and the force of nozzle spring 107, hold valve needle 116 against an opening force that acts at pressure shoulder 108 of valve needle 116.

FIG. 1*b* shows injection valve 100 in its open state, which it assumes upon energization by control device 200 in the following manner, proceeding from the idle state illustrated in FIG. 1*a*: The electromagnetic actuator, constituted in the present case by magnet coil 102 designated in FIG. 1*a* and by magnet armature 104 coacting with magnet coil 102, is acted upon by control device 200 with an energization current I, constituting an energization signal, in order to produce rapid opening of solenoid 104, 105, 112 operating as a control valve. The magnetic force of electromagnetic actuator 102, 104 is greater, in this context, than the spring force of valve spring 111 (FIG. 1*a*), so that magnet armature 104 lifts valve ball 105 off its valve seat and thus opens outflow throttle 112.

With the opening of outflow throttle 112, fuel can now flow out of valve control space 106 into the cavity located thereabove in accordance with FIG. 1*b* (cf. arrows), and via a fuel return 101 back to a fuel container (not illustrated). Inflow throttle 114 prevents a complete pressure equalization between the rail pressure present in the region of high-pressure connector 113 and the pressure in valve control space 106, so that the pressure in valve control space 106 drops. The result of this is that the pressure in valve control space 106 becomes lower than the pressure in chamber volume 109, which still corresponds to the rail pressure. The reduced pressure in valve control space 106 brings about a correspondingly reduced force on control piston 115, and thus causes opening of injection valve 100, i.e., lifting of valve needle 116 out of its valve needle seat in the region of spray orifices 110. This operating state is illustrated in FIG. 1*b*.

Subsequently, i.e., after lifting out of the valve needle seat, valve needle 116 executes a substantially ballistic trajectory, primarily in response to the hydraulic forces in chamber volume 109 and in valve control space 106.

As soon as electromagnetic actuator 102, 104 (FIG. 1*a*) is no longer being energized by control device 200, valve spring 111 pushes magnet armature 104 downward as depicted in FIG. 1*c*, so that valve ball 105 then closes off outflow throttle 112. Valve needle 116 is then moved downward, by the fuel that continues to flow via inflow throttle 114 into valve control space 106, until it once again reaches its closed position (see FIG. 1*a*).

The fuel injection operation ends as soon as valve needle 116 reaches its valve needle seat in the region of spray orifices 110 and closes them off. The total injection duration of the fuel injection operation brought about by injection valve 100 is determined substantially by the opening duration of control valve 104, 105, 112.

Figure 2:
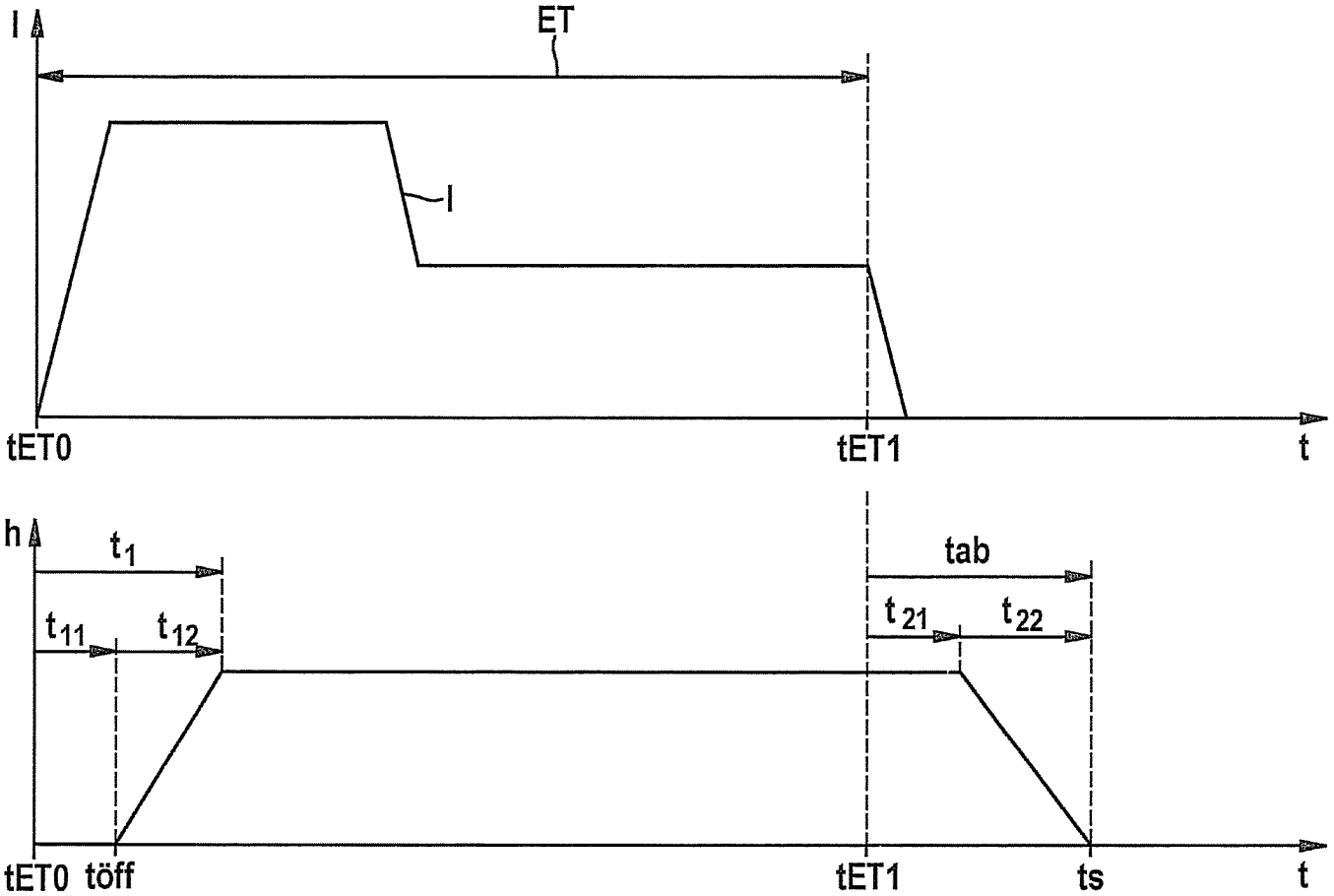
FIG. 2 shows a behavior over time of operating variables of the injection valve of FIGS. 1*a* to 1*c*.

FIG. 2 schematically shows a behavior over time of the operating variables (energization current I, valve stroke h of valve ball 105 [FIG. 1*a*]) of the control valve that occur during one energization cycle in the context of a fuel injection operation. The valve is operating here, by way of example, in its non-ballistic mode.

Firstly, at time tET0, current flows through electromagnetic actuator 102, 104 (FIG. 1*a*) of injection valve 100 in order to enable a lifting of valve ball 105 out of its idle position in the region of outflow throttle 112, and consequently to open the control valve. Time tET0 thus marks a beginning of the energization duration ET, defined by energization signal I, of electromagnetic actuator 102, 104 and thus also of control valve 104, 105, 112 of injection valve 100.

As a result of a non-infinitesimal opening delay time t11, valve ball 105 moves out of its closed position in the region of outflow throttle 112 only starting at the actual opening point in time töff. The opening delay time t11 is determined, inter alia, by the mechanical and hydraulic configuration of injection valve 100 and of the control valve.

Current flow through electromagnetic actuator 102, 104 lasts, in accordance with the diagram indicated in FIG. 2, until the end tET1 of energization duration ET, and can also exhibit different current values over energization duration ET, as depicted in FIG. 2. In the present case, a higher current level is selected for approximately the first half of energization duration ET than for the second half of energization duration ET in order to enable particularly rapid opening of the control valve.

In accordance with the diagram (likewise depicted in FIG. 2) reproducing the valve stroke h of valve ball 105, the control valve has reached its completely open state after time t1, which encompasses not only the opening delay time t11 already described but also the time t12 required for valve ball 105 to move out of its closed position into its open position. A closing delay time tab occurs, as shown in FIG. 2, after the end tET1 of energization duration ET. The closing delay time tab is made up, in the case of the configuration of injection valve 100 according to FIGS. 1*a*, 1*b*, 1*c*, of a holding delay time t21 and a closing time of flight t22 subsequent thereto. It is only at the actual closing point in time ts=tET1+tab that the control valve of injection valve 100 is once again in its closed state.

Provision is made according to the present invention that the closing delay time tab described above with reference to FIG. 2 is identified as a first delay time. This can be accomplished, according to the present invention, with the use of a conventional method such as, for example, an analysis of energization signal I or of a voltage present at magnet coil 102, or the like.

For example, point in time tET1 is already known to control device 200 (FIG. 1*a*) because of a definable energization duration ET; and point in time ts can be identified by way of the inductive feedback of magnet armature 104, connected to valve ball 105, to coil current I and/or the coil voltage at magnet coil 102 when valve ball 105 encounters its sealing set.

Figure 4:
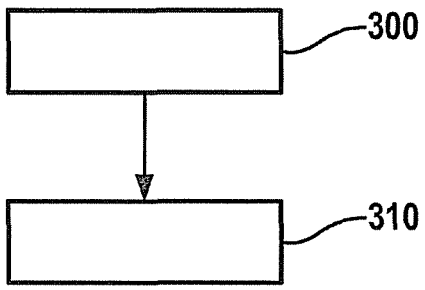
FIG. 4 is a flow chart of an example embodiment of the method according to the present invention.

Identification of the closing delay time tab with the aid of a conventional method of this kind is represented by method step 300 of the flow chart of FIG. 4.

According to the present invention, with a knowledge of closing delay time tab, opening delay time t11 (FIG. 2) is then inferred in step 310.

This means that with the use of the principle according to the present invention, instrumental acquisition of opening delay time t11 can be dispensed with provided at least one other delay time (in this case the closing delay time tab) is already known. Opening delay time t11 is instead, implementing the idea of the invention, identified from the already known closing delay time tab.

In the case of common valve types, a strong correlation exists between the closing delay time tab and the opening delay time t11; this is valid in particular for the ballistic mode of valve 100.

It is therefore advantageously possible according to the present invention, with a knowledge of the closing delay time tab (acquired, for example, instrumentally), to infer the opening delay time t11.

With a knowledge of both the opening delay time t11 and closing delay time tab, operation of valve 100 can, according to the present invention, be regulated particularly advantageously in order to achieve maximally precise metering of a fluid (such as, for example, fuel) that is to be injected.

The present invention is applicable to different types of valves and, in particular, is not limited to those injection valves 100 that are actuated by way of a control valve 104, 105, 112.

Figure 3:
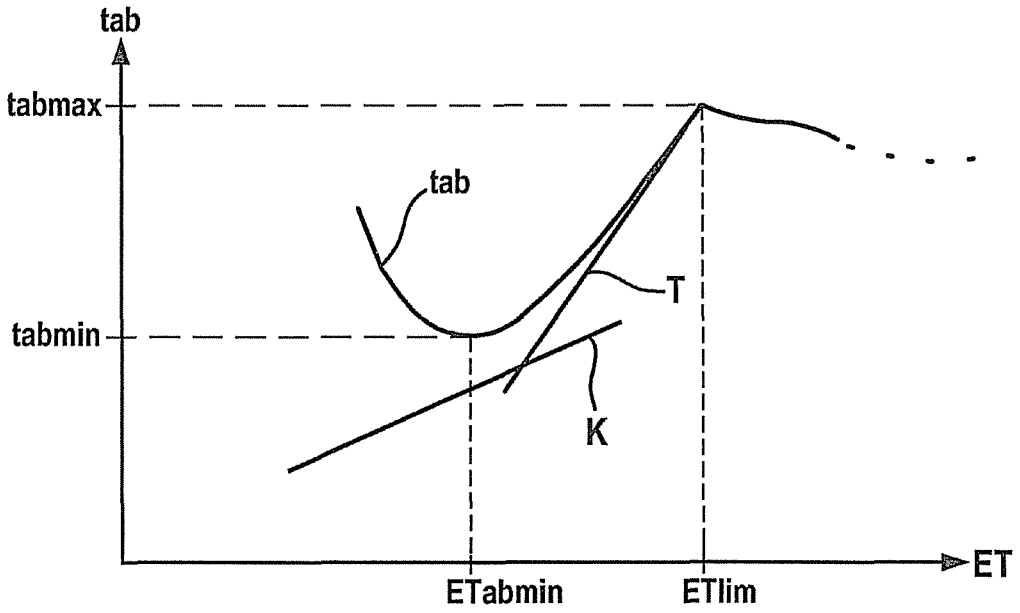
FIG. 3 shows a closing delay time of an injection valve, plotted against an energization duration.

FIG. 3 shows, by way of example, a behavior of the closing delay time tab over energization duration ET. For energization duration values ET less than or equal to ETlim, the curve for the closing delay time tab has an approximately parabolic shape.

The value ETlim marks a limit for energization duration values, below which a purely ballistic mode of valve 100 occurs. in this ballistic mode, components 104, 105 therefore execute a ballistic trajectory during energization, and do not, for example, make contact with magnet coil 102 or an iron core (not shown) that surrounds it and at the same time operates as a linear stroke stop. During pure ballistic mode, application of the method according to the present invention yields particularly precise values for the opening delay time t11 derived from closing delay time tab.

The parabolic curve depicted in FIG. 3 for closing delay time tab can be plotted, for example, during multiple energizations of valve 100, with simultaneous storage of the corresponding energization duration values ET.

With a knowledge of the behavior of the closing delay time tab, according to the present invention a corresponding opening delay time t11 can be inferred in step 310 (FIG. 4).

For example, it is possible firstly to determine, from the behavior of tab over energization duration ET (FIG. 3), a parameter that is converted, via a simple calculation formula or a characteristic curve, directly into the opening delay time t11 (see step 310 of FIG. 4).

The following variants, among others, are proposed as a parameter on which identification 310 of the opening delay time t11 according to the present invention is based:

a) that value ETabmin for the energization duration ET at which the shortest closing delay time tabmin has been identified, b) the shortest detectable closing delay time tabmin, c) an intersection point between tangent T with the curve tab=f(ET) at the point ET=ETlim of the maximum closing delay time tabmax and a previously defined reference curve K, reference curve K particularly advantageously having a linear behavior, preferably a horizontal (in FIG. 3) behavior, i.e. K=const.

d) The reference curve K can be adapted as a function of the minimum detectable closing delay time tabmin.

Instead of the behavior tab plotted against the energization duration ET, according to the present invention a behavior of the opening duration (ts−tET0) over the energization duration ET, or any linear combination of the behavior the opening duration (ts=tET0) and the behavior of the closing delay time tab, can be used to calculate a variable characterizing the opening point in time töff or the opening delay time t11, respectively.

A particular advantage of the example method according to the present invention is that additional outlay for instrumental sensing of the opening delay time t11 is avoided. For those valve types for which a direct measurement of the opening delay time t11 is in principle, for example, very difficult or in fact impossible without a separate sensor apparatus, the principle of the present invention represents a low-complexity capability for deriving the opening delay time t11 (which is of interest) from the more easily identifiable closing delay time tab.

Particularly advantageously, identification 310 (FIG. 4) according to the present invention of the opening delay time t11 can also occur with the aid of a model that reproduces an operating characteristic of valve 100. The model can have delivered to it, for example, once again the behavior of tab (FIG. 3) over the energization duration ET, as well as further operating variables that are present in control device 200 (FIG. 1*a*) or can easily be identified instrumentally.

The example method according to the present invention can be applied both to valves 100 actuated by way of control valves 104, 105, 112 and to directly actuated valves (not shown) in which actuator 102, 104 acts directly, for example, on valve needle 116.

When a corresponding correlation exists between the relevant delay times, the principle of the present invention can also be extended to the identification of multiple different delay times, proceeding, for example, from a first instrumentally acquired delay time of the relevant valve.

What is claimed is:

1. A method for operating a fuel injection valve of an internal combustion engine of a motor vehicle actuated by way of an actuator, comprising:

identifying a first delay time which characterizes a time difference between a point in time of a first change in an energization signal for the actuator and a point in time of a first change in an operating state of the valve corresponding to the first change in the energization signal; and inferring from the first delay time at least one second delay time of the valve, the at least one second delay time characterizing a time difference between a point in time of a second change, different from the first change, in the energization signal and a point in time of a second change in the operating state of the valve corresponding to the second change in the energization signal.

2. The method as recited in claim 1, wherein the first delay time is a closing delay time, and the second delay time is an opening delay time.

3. The method as recited in claim 1, wherein the first delay time is identified as a function of at least one instrumentally acquired variable.

4. The method as recited in claim 1, wherein the method is carried out in a ballistic operating range of the valve.

5. The method as recited in claim 1, wherein the first delay time is identified for different values of an energization duration during which the actuator is being energized with the energization signal; and the second delay time is inferred from a behavior of the first delay time over the energization duration.

6. The method as recited in claim 1, wherein the second delay time is identified as a function of a minimum value for the first delay time.

7. The method as recited in claim 1, wherein the second delay time is identified by way of a model that reproduces an operating characteristic of the valve.

8. A control device for operating a fuel injection valve of an internal combustion engine of a motor vehicle actuated by way of an actuator, the control device being configured to identify a first delay time that characterizes a time difference between a point in time of a first change in the energization signal for the actuator and a point in time of a first change in an operating state of the valve corresponding to the first change in the energization signal, the control device further being configured to infer from the first delay time at least one second delay time of the valve, the at least second delay time charactering a time difference between a point in time of a second change, different from the first change, in the energization signal and a point in time of a second change in the operating state of the valve corresponding to the second change in the energization signal.

9. The control device as recited in claim 8, wherein the first delay time is a closing delay time, and the second delay time is an opening delay time.

10. A storage medium storing a computer program, the computer program, when executed by a control device, causing the control device to perform the steps of:

identifying a first delay time which characterizes a time difference between a point in time of a first change in an energization signal for the actuator and a point in time of a first change in an operating state of the valve corresponding to the first change in the energization signal; and inferring from the first delay time at least one second delay time of the valve, the at least one second delay time characterizing a time difference between a point in time of a second change, different from the first change, in the energization signal and a point in time of a second change in the operating state of the valve corresponding to the second change in the energization signal.

* * * * *